US009120550B2

(12) United States Patent
Hopper et al.

(10) Patent No.: US 9,120,550 B2
(45) Date of Patent: Sep. 1, 2015

(54) VENTED STORAGE FOR BOAT

(71) Applicant: Ranger Boats, LLC, Flippin, AR (US)

(72) Inventors: Randy Wayne Hopper, Flippin, AR (US); Bradley G. Garringer, Mountain Home, AR (US)

(73) Assignee: Ranger Boats, LLC, Flippin, AK (US)

( * ) Notice: Subject to any disclaimer, the term of this patent is extended or adjusted under 35 U.S.C. 154(b) by 148 days.

(21) Appl. No.: 13/915,171

(22) Filed: Jun. 11, 2013

(65) Prior Publication Data

US 2014/0360421 A1 Dec. 11, 2014

(51) Int. Cl.
*B63J 2/08* (2006.01)

(52) U.S. Cl.
CPC ..... *B63J 2/08* (2013.01)

(58) Field of Classification Search
CPC ..... B23J 2/08
USPC ..... 114/211
See application file for complete search history.

(56) References Cited

U.S. PATENT DOCUMENTS

| | | | | | |
|---|---|---|---|---|---|
| 2,356,391 | A * | 8/1944 | Fluor, Jr. | 114/211 |
| 4,448,112 | A * | 5/1984 | Soderberg | 454/8 |
| 4,535,715 | A * | 8/1985 | McIntosh | 114/211 |
| 4,568,293 | A * | 2/1986 | Yazaki | 440/88 R |
| 4,711,193 | A * | 12/1987 | Latza et al. | 114/211 |
| 4,811,680 | A * | 3/1989 | Genth | 114/201 R |
| 4,811,682 | A * | 3/1989 | Hwang et al. | 114/345 |
| 4,991,532 | A * | 2/1991 | Locke | 114/211 |
| 4,996,937 | A * | 3/1991 | Niina et al. | 114/144 R |
| 5,176,551 | A * | 1/1993 | Blanchard et al. | 440/88 R |
| 5,195,445 | A * | 3/1993 | Riddles et al. | 114/201 R |
| 5,331,911 | A * | 7/1994 | Bost et al. | 114/26 |
| 5,417,597 | A * | 5/1995 | Levedahl | 440/6 |
| 5,490,474 | A * | 2/1996 | Ikeda | 114/343 |
| 5,709,163 | A * | 1/1998 | Livingston | 114/211 |
| 5,787,833 | A * | 8/1998 | Lewis | 114/211 |
| 5,791,952 | A * | 8/1998 | Trinkl | 440/89 R |
| 6,167,658 | B1 * | 1/2001 | Weiner | 52/2.11 |
| 6,276,290 | B1 * | 8/2001 | Yamada et al. | 114/55.51 |
| 6,484,657 | B1 * | 11/2002 | Donovan et al. | 114/201 R |
| 6,712,689 | B2 * | 3/2004 | Clarkson et al. | 454/78 |
| 6,863,582 | B1 * | 3/2005 | Wynne | 440/88 A |
| 6,957,990 | B2 * | 10/2005 | Lowe | 440/6 |
| 7,001,232 | B2 * | 2/2006 | Montgomery | 440/88 A |
| 7,004,095 | B2 * | 2/2006 | Bronneberg et al. | 114/74 R |
| 7,305,930 | B1 * | 12/2007 | Beal et al. | 114/211 |
| 8,312,829 | B2 * | 11/2012 | Black | 114/211 |
| 8,707,881 | B2 * | 4/2014 | Armstrong et al. | 114/211 |
| 2002/0011199 | A1 * | 1/2002 | Barsumian | 114/67 A |
| 2013/0025527 | A1 * | 1/2013 | Cooney | 114/363 |
| 2014/0360421 | A1 * | 12/2014 | Hopper et al. | 114/343 |

FOREIGN PATENT DOCUMENTS

| | | |
|---|---|---|
| JP | 59-081298 | 5/1984 |

* cited by examiner

*Primary Examiner* — Lars A Olson
*Assistant Examiner* — Jovon Hayes
(74) *Attorney, Agent, or Firm* — Merchant & Gould P.C.

(57) ABSTRACT

A storage system for a boat includes one or more storage compartments situated in a bow of a boat. An air flow path includes an air inlet opening, the storage compartment, and an air outlet opening. A fan is situated to move air along the air flow path. The fan may be positioned proximate one of the air inlet and the air outlet, for example.

26 Claims, 3 Drawing Sheets

VENTED STORAGE FOR BOAT

BACKGROUND

The present disclosure relates generally to storage systems for boats.

Many types of watercraft, such as fishing boats and other recreational boats have storage compartments for storing life preservers, fishing gear, recreational gear such as water skis, refreshments, and the like. For example, "bass boats" are widely used by both professional and amateur fishermen. A typical bass boat is generally provided with a centrally positioned control console disposed between elevated bow and stern deck portions. Storage compartments may be situated below some of the elevated deck portions. In some bass boats, the stern deck portions have storage compartments thereunder containing live wells, batteries, fuel tanks, etc. Some bow storage compartments are elongated, making them suitable for storing long items such as fishing rods. Items stored in such storage compartments are often valuable, and while such items may be made for use in wet or moist conditions, it may be detrimental for these items to remain in a wet or moist condition for extended periods.

Attempts have been made to make boat storage compartments "dry storages" by sealing the door openings. As the quality of such seals improves in an attempt to make storage compartments "water tight," the compartments can also become more "air tight." Fishing in rain, fog or extreme humidity, for example, can result in wet or damp equipment being put into the storage compartments. With the storage compartments being "sealed" it can be difficult for the equipment stored in the compartments to dry out. This, in turn, could promote mold growth or a musty smell.

Improvements in storage compartments are desired.

SUMMARY

In accordance with aspects of the present disclosure, a storage system for a boat includes a first compartment situated in a bow of a boat, with the first compartment having an air inlet opening. A second compartment situated in the bow of the boat, and it has an air outlet opening. An air flow path includes the air inlet opening, the first compartment, the second compartment, and the air outlet opening. A fan is situated to move air along the air flow path. The fan may be positioned proximate one of the air inlet and the air outlet, for example. In some implementations, the air flow path includes at least one compartment-to-compartment air-flow vent.

Further, in some embodiments, a third storage compartment is positioned at a central location along a keel of the boat. The first compartment is positioned at either the port side or starboard side of the boat, and the second compartment is positioned at the other side of the boat. The third storage compartment is positioned between the first and second compartments and at least the third storage compartment is a fishing rod storage compartment. The first, second and third compartments have upper access doors that define at least a portion of a deck of the bow.

In accordance with further aspects of the present disclosure, a boat includes a hull with a storage compartment situated in the hull. The storage compartment has a top surface forming a first portion of a deck of the boat and an upper access door movably connected to the top surface to selectively provide access to an inside area of the storage compartment. The upper access door forms a second portion of the deck of the boat. An air flow path includes the air inlet opening, the storage compartment, and the air outlet opening, and a fan is situated to move air along the air flow path. The fan may be positioned proximate the air inlet or the air outlet, for example.

In accordance with still further aspects of the disclosure, a method for venting storage compartments of a boat includes situating a first compartment in a bow of a boat and providing an air inlet opening in the first compartment. A second compartment is also situated in the bow of the boat with an air outlet opening provided in the second compartment. At least one compartment-to-compartment air-flow vent is provided, and air is moved along an air flow path including the air inlet opening, the first compartment, the compartment-to-compartment air flow vent, the second compartment, and the air outlet opening. A fan may be operated, for example, proximate one or more of the air inlet opening, the compartment-to-compartment air flow vent, and the air outlet opening to move the air along the airflow path.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as top, bottom, front, back, etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention.

The present disclosure relates generally to storage systems for boats. Many types of boats, such as fishing boats and other recreational boats include storage compartments for fishing gear, life preservers, recreational items such as water skis, fishing rods and other fishing gear, etc.

Figure 1:
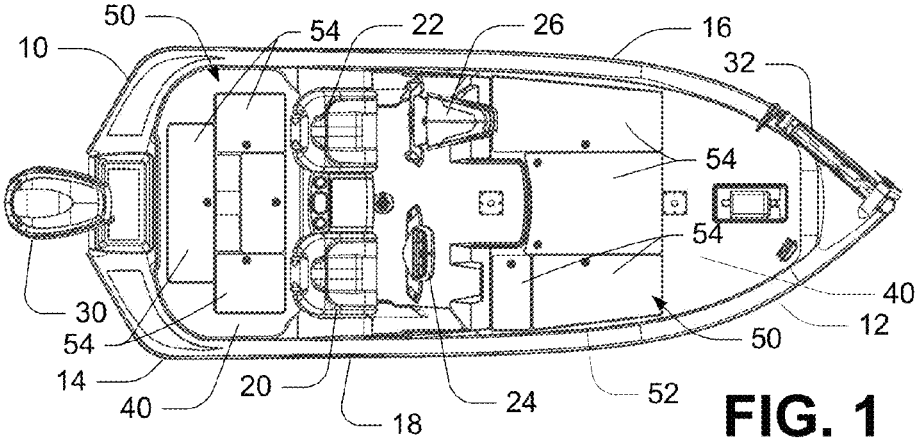
FIG. 1 is a top view illustrating an example of a boat employing a storage system in accordance with the present disclosure.
Figure 2:
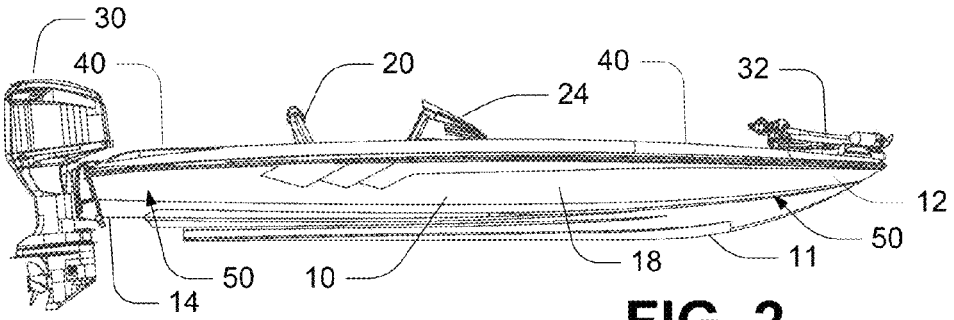
FIG. 2 is a side view of the boat of FIG. 1.

FIGS. 1 and 2 are top and side views, respectively, illustrating aspects of an example of a bass boat 10. The illustrated bass boat 10 has a hull 11 with a bow 12 and a stern 14, and port and starboard sides 16,18. A driver seat 20 and one or more passenger seats 22 are centrally located, along with a cockpit console 24 and passenger console 26. The illustrated boat 10 further includes an outboard motor 30 situated at the stern 14 and a trolling motor 32 positioned at the bow 12.

The bow 12 and stern 14 each have a raised deck 40 on either side of the cockpit 24/passenger console 26 and driver 20/passenger 22 seats. With some fishing boats, such as the example bass boat 10, the deck 40 provides a raised platform to facilitate casting and generally moving about the boat 10 as desired. Thus, in such examples the deck 40 must be sturdy enough to support the boat occupants. The surface of the deck 40 is sometimes provided with a non-slip surface to further facilitate such activities on the deck 40.

One or more deck storage compartments 50 are situated between the deck 40 and the hull 11 of the boat. The storage compartment 50 includes a top surface 52 with one or more access doors 54 movably connected thereto such that the doors can be opened as desired to provide access to the inside area of the storage compartment 50. Thus, the top surfaces 52 along with the access doors 54 form respective portions of the deck 40. In the illustrated example, hinges connect the doors 54 to the top surfaces 52, allowing the doors 54 to be selectively opened or closed. As can be seen in FIG. 1, the storage compartments 50 in the bow 12 are elongated, providing convenient storage for long items such as fishing rods. Accordingly, some of these storage compartments 50 are sometimes referred to as "rod boxes."

Figure 3:
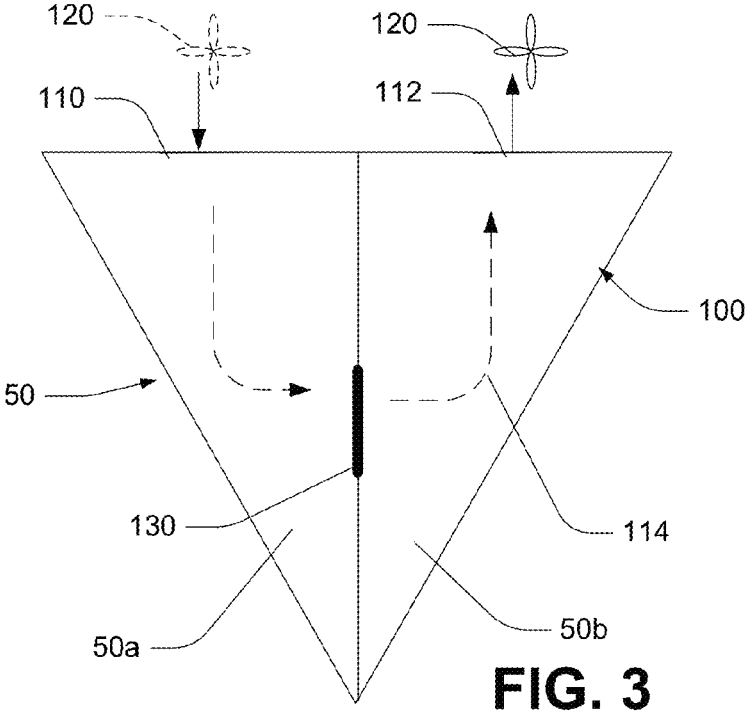
FIG. 3 is a block diagram conceptually illustrating an example of a storage system in accordance with the present disclosure.

When the access doors 54 are opened, items stored in the storage compartments 50 can get wet from rain or splashing water, for example. To help dry or at least reduce the moisture inside the storage compartments 50, a ventilation system is provided. FIG. 3 conceptually illustrates an example of a vented storage compartment system in accordance with aspects of the present disclosure. The storage system 100 includes a storage compartment 50 situated in the hull 11 of the boat 10. As noted above in conjunction with FIGS. 1 and 2, the storage compartment 50 has a top surface 52 that forms a portion of the deck 40 of the boat 10, and an upper access door 54 that is movably connected to the top surface 52 to selectively provide access to an inside area of the storage compartment 50. The upper access door 54 forms another portion of the deck 40. The illustrated example refers to storage compartments situated in the bow 12, though other embodiments are envisioned in which the disclosed concepts are applied to storage compartments in other areas of the boat, such as the stern or central area of the boat depending on the particular boat configuration.

The storage compartment 50 has an air inlet opening 110 and an air outlet opening 112 that form an air flow path 114 including the air inlet opening 110, the storage compartment 50, and the air outlet opening 112. A fan 120 is situated to move air along the air flow path, thus moving air through the storage compartment 50 to remove moisture from the inside of the compartment 50 and the contents thereof. As used herein, a fan is any device that actively moves air, such as a typical mechanical axial fan having rotating vanes or blades. In one embodiment, a 12 volt, 3800 RPM fan is employed providing air flow of 170 CFM. Other air moving devices could be used. In some implementations, the fan 120 is positioned at the air outlet 112, though the fan could be positioned in other locations to move air along the air flow path 114 as desired. For instance, the fan could be placed proximate the air inlet opening 110 as indicated by the fan 120 shown in broken lines in FIG. 3. In the illustrated embodiment, the air outlet 112 is positioned at the port side 16 of the boat 10, and the air inlet 110 is positioned at the starboard side 18. Further, both the air inlet 110 and air outlet 112 face towards the stern 14. Thus, for the illustrated storage system 100 situated in the bow 12 of the boat, the air inlet 110 and air outlet 112 face towards the interior of the boat 10. Such positioning helps keep water from entering the storage compartment 50 through the air inlet 110 or air outlet 112, such as from rain or water splashing onto the deck 40.

In some examples of the storage system 100, the storage compartment 50 includes multiple compartments. In FIG. 3, the storage compartment 50 has a first compartment 50*a* with the air inlet opening 110, and a second compartment 50*b* with the air outlet opening 112. Thus, the air flow path 114 includes the air inlet opening 110, the first compartment 50*a*, the second compartment 50*b*, and the air outlet opening 112. In some examples of the system 100, the air flow path 114 includes a compartment-to-compartment air-flow vent 130, wherein air to flows from the first compartment 50*a*, through the vent 130 to the second compartment 50*b*.

Figure 4:
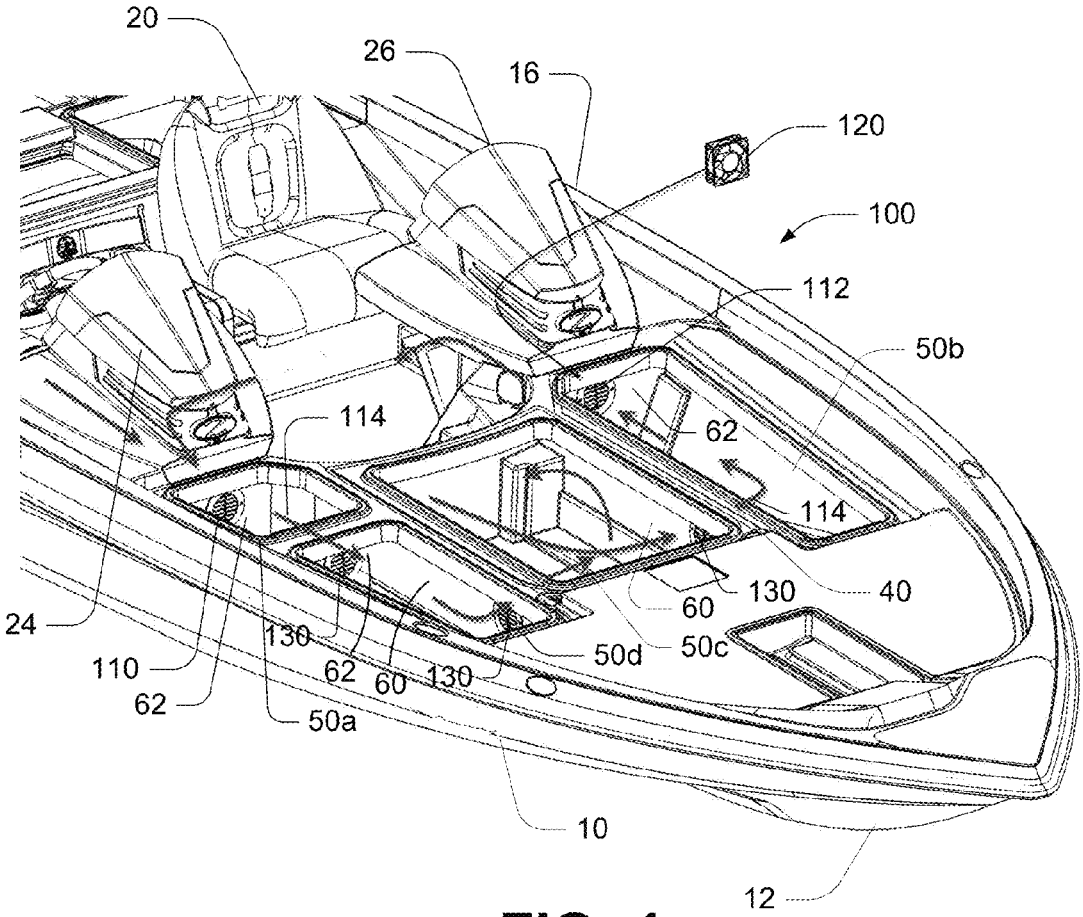
FIG. 4 is a front perspective view of a portion of a boat having a storage system in accordance with the present disclosure therein.
Figure 5:
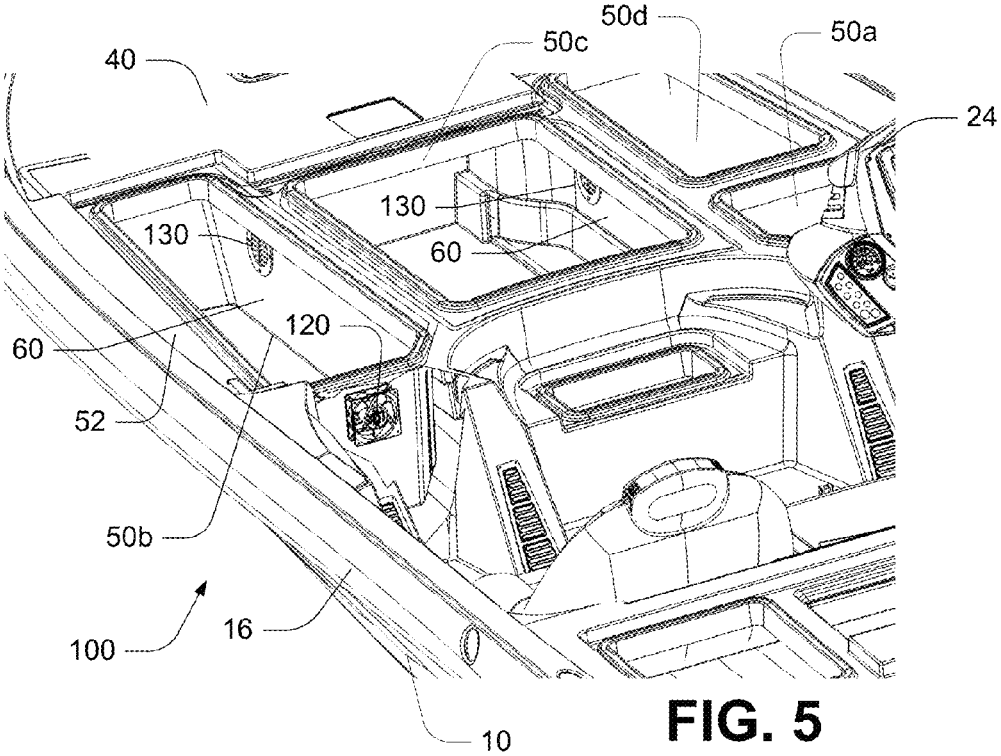
FIG. 5 is a close up view of a portion of the port side of the boat shown in FIG. 4.
Figure 6:
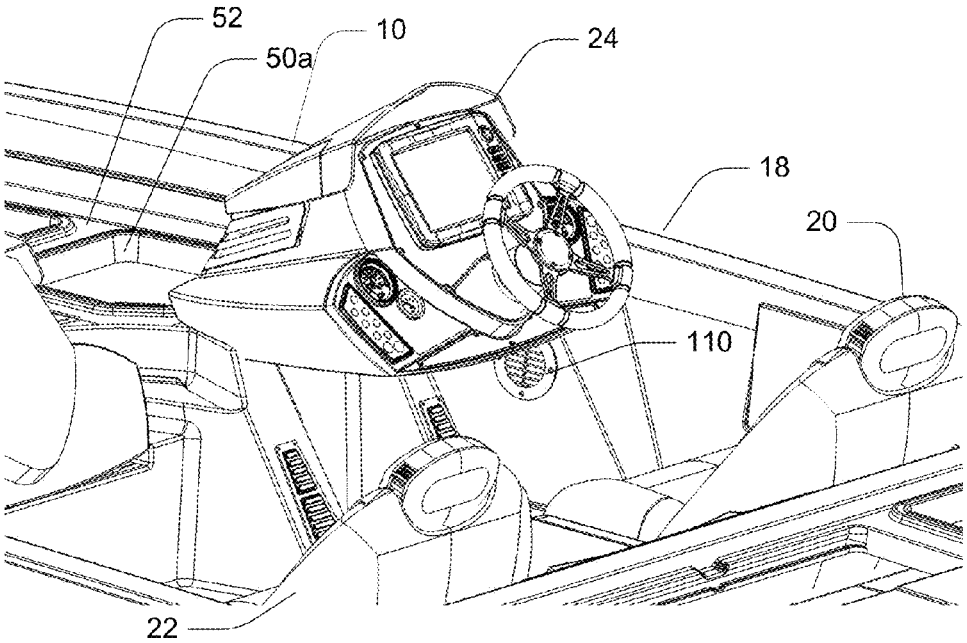
FIG. 6 is a close up view of a portion of the starboard side of the boat shown in FIG. 4.

FIGS. 4-6 illustrate an embodiment of the storage system 100. The illustrated storage system is 100 is situated in the bow 12 of the boat 10. In FIGS. 4-6, the access doors 52 are omitted for more convenient viewing of the insides of the storage compartments 50. The air flow path 114 is illustrated by several arrows conceptually indicating air flow in the system 100. In addition to the first and second compartments 50*a*,50*b* shown in FIG. 3, the embodiment shown in FIG. 4 includes third and fourth compartments 50*c*,50*d* situated along the air flow path 114 between the first and second compartments 50*a*,50*b*.

In the system illustrated in FIG. 4, the fan 120 (shown outside the boat 10 for ease of illustration) is situated proximate the air outlet opening 112 on the port side 16 as indicated by the arrow between the fan 120 and the air outlet opening 112. Alternatively, the fan 120 could be positioned at the air inlet opening 110, or multiple fans 120 could be positioned at each opening 110, 112. In the illustrated example, the air inlet and outlet openings 110,112 are covered by a louvered vent, with both the air inlet opening 110 and air outlet opening 112 facing towards the interior of the boat 10. The inlet opening 110 is situated under the cockpit console 24 and the outlet opening 110 is situated under the passenger console 26. FIG. 5 is a close-up view of a portion of the port side 16 with the passenger console 26 removed to show the positioning of the fan 120 in the air outlet opening 112, facing towards the interior of the boat 10. FIG. 6 illustrates the cockpit console 24 on the starboard side 18 of the boat 10, showing the inlet opening 110 situated under the cockpit console 24, also facing towards the interior of the boat 10. The inlet and/or outlet 110,112 could be positioned so as to face towards the stern 14 of the boat, or could face towards the centerline, top, exterior, etc. of the boat 10 via additional air passages or ducts. In general, the illustrated inlet and outlet 110,112 do not vent to an engine compartment (the illustrated boat 10 has an outboard motor 30) or living quarters below the deck 40, for example, but rather are situated to vent storage compartments.

As best seen in FIGS. 4 and 5, the air flow path 114 includes compartment-to-compartment air-flow vents 130 between adjacent ones of the storage compartments 50. In the illustrated example, the storage compartments 50 include side walls 60 that extend generally vertically between the underside of the deck 40 and the hull 12, with the compartment-to-compartment air-flow vents 130 situated in the side walls 60. The first and second compartments 50*a*,50*b* are situated in the starboard and port sides, respectively. The third storage compartment 50*c* is positioned at a central location along the keel of the boat 10, between the first and second compartments 50*a*,50*b* such that the air flow path 114 loops along a generally U-shaped path. The fourth storage compartment 50*d* is also positioned along the starboard side of the boat adjacent the first compartment 50*a*. The elongated second and third compartments 50*b*,50*c* are arranged as rod boxes in some embodiments. A fan 120 could be situated in or adjacent to one or more of the air flow vents 130 in place of, or in addition to, the fan 120 situated proximate the outlet 112 and/or inlet 110.

In the illustrated system 100, the first, second and fourth compartments 50*a*,50*b*,50*d* each include an end wall 62 that extends from the underside of the deck 40 to the hull 12, oriented generally perpendicular to the sidewalls 60. The sidewalls 60 and end walls 62 may not be precisely perpendicular to one another due to the shape of the bow 16 of the boat 10. In the example shown in FIGS. 4 and 5, the air inlet 110 is in the compartment 50*a* end wall 62, and the outlet 112 is in the second compartment 52*b* end wall 62. The an air flow vent 130 extending between the first and fourth compartments 50*a*,50*d* is situated in the end wall 62 between these compartments.

In some example implementations, the interior volume of the storage compartments 50 range from about 5 cubic feet to about 9 cubic feet, with a total storage volume of the compartments 50 being about 29 cubic feet. In the illustrated embodiments, the storage compartments 50 are generally rectangular, though the actual shape of the various storage compartments 50 varies depending on, for example, the shape of the hull 12 and bow 16 of the boat 10. The depth (vertical distance between the underside of the deck 40 and the hull 12) varies from about 12 to 16 inches in some examples for the various compartments 50, depending on their particular location. In one particular example, the length and width dimensions are about 24×26 inches, 36×22 inches, 48×27 inches, and 60×16 inches for the storage compartments 50*a*, 50*d*, 50*c*, 50*b*, respectively, illustrated in FIG. 4.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A storage compartment system for a boat, comprising:

a first compartment situated in a bow of a boat, the first compartment having an air inlet opening;

a second compartment situated in the bow of the boat, the second compartment having an air outlet opening;

an air flow path including the air inlet opening, the first compartment, the second compartment, and the air outlet opening; and a fan situated to move air along the air flow path;

wherein the first and second compartments include upper access doors that form at least a portion of a deck of the bow.

2. The storage compartment system of claim 1, wherein the fan is positioned proximate one of the air inlet and the air outlet.

3. The storage compartment system of claim 2, wherein the fan is positioned proximate to the air outlet.

4. The storage compartment system of claim 1, wherein the air flow path includes at least one compartment-to-compartment air-flow vent.

5. The storage compartment system of claim 4, wherein the compartment-to-compartment air-flow vent is provided in a compartment side wall.

6. The storage compartment system of claim 1, further comprising:

a third compartment situated in the bow of the boat, the third compartment being positioned along the air flow path, and the air flow path including a plurality of compartment-to-compartment air-flow vents.

7. The storage compartment system of claim 1, wherein one of the air inlet and the air outlet is positioned at a port side of the boat, and the other of the air inlet and the air outlet is positioned at a starboard side of the boat.

8. The storage compartment system of claim 6, wherein the third storage compartment is positioned at a central location along a keel of the boat, wherein the first compartment is positioned at one of a port side or starboard side of the boat, wherein the second compartment is positioned at the other of the port or starboard side of the boat, wherein the third storage compartment is positioned between the first and second compartments, wherein the third storage compartment is a fishing rod storage compartment, and wherein the first, second and third compartments have upper access doors that define at least a portion of a deck of the bow.

9. The storage compartment system of claim 8, wherein the compartment-to-compartment air-flow vents are provided in compartment side walls.

10. The storage compartment system of claim 1, wherein the air inlet opening and the air outlet opening face towards a stern of the boat.

11. The storage compartment system of claim 1, wherein the first and second compartments each include a top surface that forms a portion of the deck of the bow.

12. The storage compartment system of claim 6, wherein the first storage compartment is on one of the port and starboard sides, the second storage compartment is on the other of the port and starboard sides, such that the air flow path loops in a U-shaped path.

13. The storage compartment system of claim 6, further comprising:

a fourth compartment situated in the bow of the boat, the fourth compartment being positioned along the air flow path.

14. The storage compartment system of claim 5, wherein the first and second compartments each include an end wall, wherein the air inlet is in one of the first and second compartment end walls, and the outlet is on the other of the first and second compartment end walls.

15. The storage system of claim 14, wherein the end walls are oriented perpendicular to the compartment side wall.

16. A boat, comprising:

a hull;

a storage compartment situated in the hull;

the storage compartment situated in a bow of the boat and having a top surface forming a first portion of a deck of the boat;

an upper access door movably connected to the top surface to selectively provide access to an inside area of the storage compartment, the upper access door forming a second portion of the deck of the boat;

an air inlet opening;

an air outlet opening;

an air flow path including the air inlet opening, the storage compartment, and the air outlet opening; and a fan situated to move air along the air flow path.

17. The boat of claim 16, wherein the inlet opening and the outlet opening are both oriented towards an interior of the boat.

18. The boat of claim 16, wherein the fan is positioned proximate one of the air inlet and the air outlet.

19. The boat of claim 16, wherein one of the air inlet and the air outlet is positioned at a port side of the boat, and the other of the air inlet and the air outlet is positioned at a starboard side of the boat.

20. The boat of claim 16, further comprising:

a cockpit console, wherein at least one of the inlet opening and the outlet opening is situated under the cockpit console.

21. The boat of claim 16, further comprising:

a cockpit console; and a passenger console;

wherein the inlet opening is situated under one of the cockpit console and the passenger console, and the outlet opening is situated under the other of the cockpit console and the passenger console.

22. The boat of claim 16, further comprising:

a plurality of the storage compartments situated in the hull;

wherein the air flow path includes the plurality of air flow vents.

23. The boat of claim 22, wherein:

the air inlet is in a first one of the plurality of storage compartments;

the air outlet is in a second one of the plurality of storage compartments; and the air flow path includes at least one compartment-to-compartment air-flow vent.

24. The boat of claim 23, wherein:

the plurality of storage compartments includes a third storage compartment and a fourth storage compartment;

the first compartment is positioned along a starboard side of the boat;

the second compartment is positioned along a port side of the boat;

the third storage compartment is positioned at a central location along a keel of the boat;

the fourth storage compartment is positioned along the starboard side of the boat adjacent the first compartment; and the air flow path includes the third and fourth storage compartments and a plurality of the compartment-to-compartment air-flow vents.

25. A boat, comprising:

a hull;

a storage compartment situated in the hull;

the storage compartment having a top surface forming a first portion of a deck of the boat;

an upper access door movably connected to the top surface to selectively provide access to an inside area of the storage compartment, the upper access door forming a second portion of the deck of the boat;

an air inlet opening;

an air outlet opening;

a cockpit console, wherein at least one of the inlet opening and the outlet opening is situated under the cockpit console;

an air flow path including the air inlet opening, the storage compartment, and the air outlet opening; and a fan situated to move air along the air flow path.

26. The boat of claim 25, further comprising a passenger console;

wherein the inlet opening is situated under one of the cockpit console and the passenger console, and the outlet opening is situated under the other of the cockpit console and the passenger console.

* * * * *